United States Patent [19]

Elliott

[11] Patent Number: 4,529,113

[45] Date of Patent: Jul. 16, 1985

[54] MARGIN STRIPPER

[76] Inventor: Judith D. Elliott, 1111 Westcliff, Portland, Tex. 78374

[21] Appl. No.: 523,354

[22] Filed: Aug. 15, 1983

[51] Int. Cl.[3] ..... B26F 3/02

[52] U.S. Cl. ..... 225/1; 225/106

[58] Field of Search ..... 225/1, 101, 106; 83/455, 467

[56] References Cited

U.S. PATENT DOCUMENTS

| | | | |
|---|---|---|---|
| 125,204 | 4/1872 | McCullagh . | |
| 442,414 | 12/1890 | Blanchard . | |
| 492,354 | 2/1893 | Harrison . | |
| 568,400 | 9/1896 | Blanchard . | |
| 863,271 | 8/1907 | Fritch et al. . | |
| 867,978 | 10/1907 | Gillespie . | |
| 912,981 | 2/1909 | Graves . | |
| 1,032,359 | 7/1912 | Gibbs . | |
| 1,249,309 | 12/1917 | Bottle . | |
| 1,489,462 | 4/1924 | Schooley . | |
| 1,849,166 | 3/1932 | Adams . | |
| 2,579,835 | 12/1951 | Lather | 225/101 |
| 2,711,793 | 6/1955 | Zalkind | 225/101 |
| 2,730,174 | 1/1956 | Weinstein | 225/101 |
| 2,812,567 | 11/1957 | Zalkind | 225/101 |
| 3,190,516 | 6/1965 | Eriksen | 225/101 |

*Primary Examiner*—Frank T. Yost

*Attorney, Agent, or Firm*—G. Turner Moller

[57] ABSTRACT

This device is used to tear the perforated margins off of a stack of computer paper. Because body weight of the user is employed to stabilized the perforated margins, persons of modest strength are able to tear the margins off of large stacks, for example sixty sheets, of computer paper in one pass.

13 Claims, 4 Drawing Figures

MARGIN STRIPPER

This invention relates to a technique and device for tearing the margins off of a stack of edge-driven, continuous-feed pages exemplified by computer paper.

Most computers and many word processors employ edge feed printers in which sprocket wheels engage perforations or apertures provided in the edge margins of the paper which is continuously fed through the printer. The paper is typically received from the supplier in a folded condition, is fed through the printer and refolds in the output tray of the printer. It is typically desirable to remove the perforated margins of the finished document. This is now done merely by tearing the margins off of the paper along a weakened or perforated line which is typically one-half inch from the outer paper edge.

Tearing the margins off of computer paper is a fairly laborious chore. Although there are power driven devices which are presently available to strip the margins off of computer paper, there is presently nothing commercially available which is simple and inexpensive to manufacture and which can be manipulated by persons of modest strength to tear the margins off of a large stack of computer paper.

Of some interest relative to the device of this invention are the disclosures in U.S. Pat. Nos. 125,204; 442,414; 492,354; 568,400; 863,271; 867,978; 912,981; 1,032,359; 1,249,309; 1,489,462 and 1,849,166. With the exception of U.S. Pat. No. 125,204, these patents relate to paper tearing devices and typically are ticket cutters used to tear a printed ticket in such a fashion as to indicate the paid destination of the ticket holder.

In summary, this device comprises a mechanism for tearing the margins off of a stack of edge-driven, continuous feed pages of the type having a central area, on which writing is placed, which is divided from a margin which engages a drive mechanism on a printer by a perforated line. These pages are typically connected and folded into the stack which is manipulated and torn by the mechanism of this invention.

The device of this invention comprises a pair of leaves which are pivoted together along one edge. For purposes of convenience, these leaves are called a base and a cover, there being no intention to imply that one must necessarily lie on the other. An abutment is affixed to the base and extends generally parallel to the pivot axis and projects substantially perpendicularly from the base for engaging the edge of the paper stack. This abutment positions the margins and perforated line at a predetermined distance from the axis. A rib is carried on the cover and extends generally parallel to the abutment and is spaced further from the axis than the abutment. In the closed position of the leaves, the rib engages the paper margins such that the outer edge lies substantially at the same predetermined distance from the axis as the perforated line in the paper. By placing body weight on the leaves, the rib and abutment are forced toward each other so that the paper is clamped very securely therebetween. The user merely grasps the stack of paper, adjacent the perforated line, and pulls upwardly. Because the paper is so securely held by the device, it tears quite uniformly along the perforated line.

Persons of quite modest strength have succeeded in tearing margins from fairly large paper stacks, for example sixty sheets, with no substantial difficulty. It will accordingly be seen that the device of this invention is a simple, inexpensive and relatively foolproof device for stripping perforated margins from computer paper.

It is an object of this invention to provide an improved device for stripping margins from edge driven, continuous feed paper which is normally arrayed in stacks.

Other objects and advantages of this invention will become more fully apparent as this description proceeds, reference being made to the accompanying drawings and appended claims.

Figure 1:
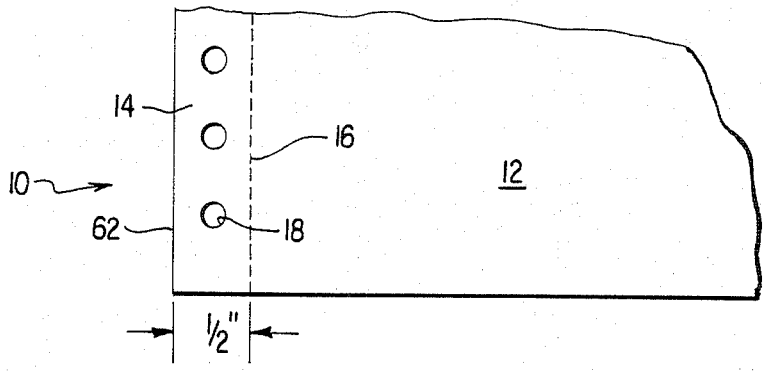
FIG. 1 is a partial view of a sheet of computer paper used in the device of this invention.

Referring to FIG. 1, there is illustrated a sheet of paper 10 of the type that is presently customarily used in computer printers, word processor printers and the like, which comprises a central area 12 on which writing is placed and a pair of edge margins 14 separated therefrom by a perforate line 16 which comprises an area of weakness promoting the separation of the margin 14 from the central area 12. The margins 14 are used to engage drive mechanisms of the printer and are typically provided with a series of perforations or apertures 18 which receive the spokes of the drive mechanism. In normal use, the sheets 10 are folded, one upon another, to form a stack 20 in which the perforated lines 20 define a pair of spaced parallel planes 22.

Figure 2:
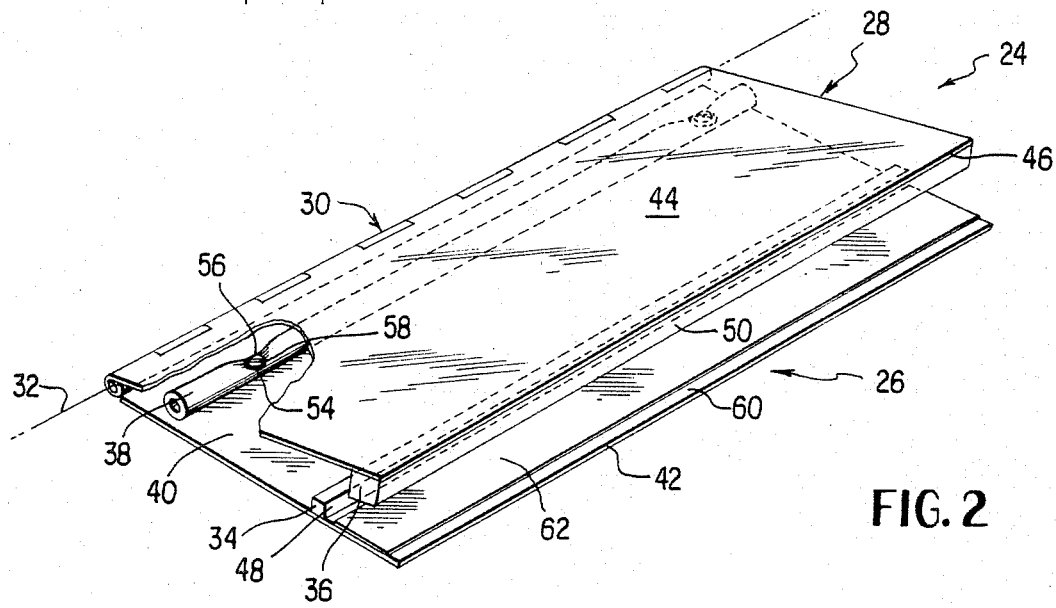
FIG. 2 is an isometric view of the device of this invention illustrated in its open or paper receiving configuration.

Referring to FIG. 2, the device 24 of this invention is illustrated. The device 24 comprises, as major components, a pair of leaves 26, 28 pivotally connected by a hinge mechanism 30 for movement about an axis 32, an abutment 34 on the leaf 26, a rib 36 on the leaf 28 and spring means 38 biasing the leaves 26, 28 into a partially open position.

Figure 3:
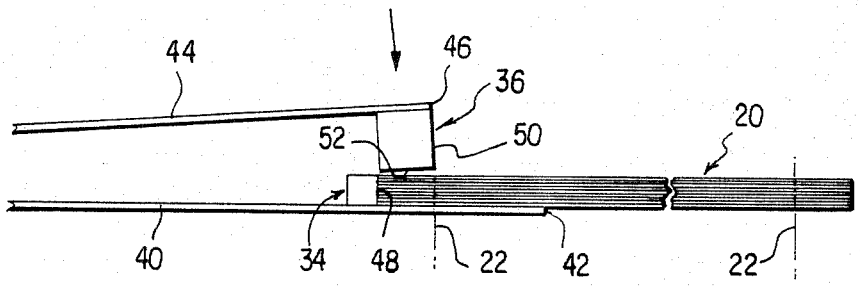
FIG. 3 is a partial side elevational view of the device of FIG. 1 illustrated in its closed position operating on a fairly large stack of paper.

The leaf or base 26 comprises a rectangular sheet 40 of rigid material having one side joined to the hinge 30 and an outer side 42 generally parallel to the axis 32. The leaf or cover 28 comprises a sheet 44 of rigid material of generally rectangular configuration having one side joined to the hinge 30 and an outer side 46 parallel to the axis 32. As shown best in FIGS. 3 and 4, the sheet 40 is larger than the sheet 44 in a dimension perpendicular to the axis 32 so that the outer edge 42 lies beyond the outer side 46.

The abutment 34 may be of any suitable type commensurate with its desired functions and conveniently comprises a rectangular or square bar rigidly affixed to the sheet 40. The abutment 34 comprises a vertical wall 48 perpendicular to sheet 40 and extending generally parallel to the axis 32. The wall 48 intersects the sheet 40 at a location spaced from the outer side 42 and is conveniently about $1\frac{1}{2}$ inches from the outer edge 42.

The rib 36 may also be of any desired configuration and conveniently comprises a bar of rectangular or square cross-section which is rigidly affixed to the sheet 44 so that the outer side 50 of the abutment 36 is generally coplanar with the outer edge 46. The outer side 50 preferably comprises a wall perpendicular to the sheet 44 and spaced from the wall 48 approximately the same distance as the perforate line 16 is spaced from the outer edge of the margin 14. As will be pointed out more fully hereinafter, the rib 50 preferably provides a planar bottom or base 52 which engages the margin 14 in the operative position of the device 24.

The spring means 38 is desirably provided to bias the leaves 26, 28 apart so that the device 24 is always ready to accept a stack of margins. Although the spring means 38 may be of any suitable type, it is illustrated as comprising a length of surgical tubing 54 secured to one of the leaves 26, 28 in any suitable fashion, as by the provision of a threaded fastener 56 and washer 58. It will accordingly be evident that the natural resiliency of the surgical tubing 54 restores the tubing to a generally cylindrical shape. Since the tubing 54 is fairly close to the hinge 30, the weight of the leaf 28 and rib 36 are supported on the tubing 54 thereby placing the leaves 26, 28 in a partially open position in which they define an acute angle.

In order to use the device 24, an individual inserts the margin side of a stack 20 into the opening between the rib 36 and the sheet 40. With the weight of the stack being supported on a section 60 of the sheet 40, the stack 20 is moved toward the axis 32 until the outer edges 62 of the margins 14 abut the vertical wall 48. The user then places one hand on the sheet 44 and presses downwardly, as by applying body weight thereto. The sheet 44 is moved in opposition to the spring 38 until the rib 36 comes to rest on top of the margin 14 of the upper sheet of the stack.

The sheet 44 and rib 36 are sufficiently strong to transmit a substantial amount of body weight without warping. It will accordingly be seen that the base 52 of the rib 36 transmits substantially all of the body weight onto the margins 14 to be removed. With the rib 36 held securely down, the user then grasps the paper stack 20 adjacent the plane 22 next to the rib 36 and pulls upwardly on the stack. Because of the weakened area afforded by the perforate line 16 and the clamping action occuring between the rib 36 and sheet 40, the margins 14 are torn simultaneously along their respective perforate lines 16. After one set of the margins 14 have been removed, the stack 20 is turned 180 degrees and the other margins may be stripped off of the central areas 12 in the same fashion.

Figure 4:
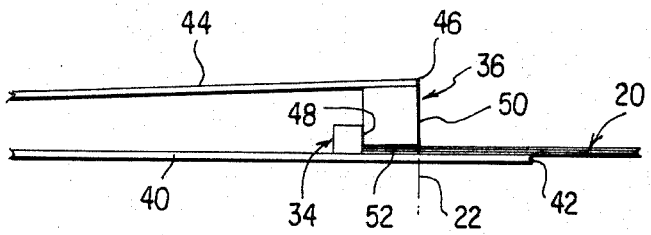
FIG. 4 is a view similar to FIG. 3 illustrating the device of this invention operating on a relatively small stack of paper.

It is desirable that the area 60 have a rougher finish than polished metal since the paper may tend to slip if a thin stack of pages are being stripped as shown in FIG. 4. To this end, all or part of the section 60 may be covered with a suitable textured material, such as a strip of tape 64.

It will accordingly be seen that there is provided a device for stripping margins off of computer paper and the like.

Although the invention has been described in its preferred form with a certain degree of particularity, it is understood that the present disclosure of the preferred form is only by way of example and that numerous changes in the details of operation and in the combination and construction of parts may be resorted to without departing from the spirit and scope of the invention as hereinafter claimed.

I claim:

1. A device for tearing the margins off of a stack of edge driven continuous feed pages of the type having a central area, on which writing is placed, divided by a perforate line from the margin which engages a drive mechanism, the pages being connected and folded into the stack, the device comprising a base, a cover and means mounting the base and cover for pivotal movement about an axis between a first open position in which the base and cover define an acute angle and a second closed position in which the base and cover substantially overlie;

an abutment, on the base extending generally in the direction of the axis, for engaging the edge of the stack and positioning the perforate line at a predetermined distance from the axis; and a rib, on the cover extending generally parallel to the abutment, the rib having an outer edge, linear from end to end, at substantially the predetermined distance for the axis.

2. The device of claim 1 wherein the rib is of generally rectilinear cross-section, the outer edge being parallel to the axis.

3. The device of claim 1 wherein the cover and base are generally planar.

4. The device of claim 1 wherein the base provides an outer edge away from the pivot axis and the abutment provides an outer wall perpendicular to the cover at a location spaced closer to the axis than the outer edge.

5. The device of claim 4 wherein the rib is of generally rectilinear cross-section, the rib outer edge being parallel to the axis.

6. The device of claim 5 wherein the rib outer edge being about ½ inch from the outer wall.

7. The device of claim 1 wherein the rib and the base comprise, in the closed position, a pair of jaws for gripping the margins therebetween, the device being free of any additional margin gripping jaws.

8. The device of claim 1 further comprising means normally biasing the cover and base away from each other into the first open position, the biasing means comprising an elastic member.

9. The device of claim 8 wherein the elastic member comprises a length of surgical tubing between the cover and base adjacent the pivotal mounting means.

10. A device for tearing the margins off of a stack of edge driven continuous feed pages of the type having a central area on which writing is placed, divided by a perforate line from the margin which engages a device mechanism, the pages being connected and folded into the stack, the device comprising a planar base having first and second edges, a planar cover having first and second edges and a pivot connection securing the first edge of the plate and cover together allowing pivotal movement therebetween for moving the base and cover about an axis between a first open position and a second closed position in which the base and cover substantially overlie;

an abutment, on the base extending generally in the direction of the axis, for engaging the edge of the stack and positioning the perforate line at a predetermined distance from the abutment;

a rib, on the cover extending generally parallel to the abutment, the rib having an outer edge, linear from end to end, juxtaposed to the perforate line in the second closed position; and a spring between the base and cover for biasing the same into the first open position.

11. A method of tearing the margins off of a stack of edge driven continuous feed pages of the type having a central area, on which writing is placed, divided by a perforate line from the margin which engages a drive mechanism, the pages being connected and folded into the stack, by using a device comprising a base, a cover and means mounting the base and cover for pivotal movement about an axis between a first open position in which the base and cover define an acute angle and a second closed position in which the base and cover substantially overlie; an abutment, on the base extending generally in the direction of the axis, for engaging the edge of the stack and positioning the perforate line at a predetermined distance from the axis; and a rib, on the cover extending generally parallel to the abutment and spaced further from the axis than the abutment, the rib having an outer edge, linear from end to end, at substantially the predetermined distance from the axis, the method comprising placing the stack of pages between the base and cover in the first open position thereof and abutting the edge of the margins against the abutment; then moving the base and cover toward the second closed position thereof and forceably placing the rib on the margin facing the rib at a location juxtaposed to the perforate line; then moving the central area of the stack relative to the margins and tearing the central area of all of the pages from their respective margins along the perforated lines.

12. The method of claim 11 wherein the base rests on a horizontal support and the cover is superposed thereto, the placing step comprises applying body weight to the cover for clamping the rib solidly against the margin, and the last mentioned moving step comprises pulling the area of the stack adjacent the rib upwardly away from the clamped margins.

13. The method of claim 12 wherein the stack of pages is free from interleaved carbons.

* * * * *